US007438015B1

(12) United States Patent
Schwindaman

(10) Patent No.: US 7,438,015 B1
(45) **Date of Patent: *Oct. 21, 2008**

(54) FOLDING TOP ASSEMBLY WITH SAFETY AND CONVENIENCE FEATURES

(76) Inventor: Michael A. Schwindaman, 24141 North St., Cassopolis, MI (US) 49031

( * ) Notice: Subject to any disclaimer, the term of this patent is extended or adjusted under 35 U.S.C. 154(b) by 0 days.

This patent is subject to a terminal disclaimer.

(21) Appl. No.: 11/697,629

(22) Filed: Apr. 6, 2007

Related U.S. Application Data

(63) Continuation-in-part of application No. 11/192,383, filed on Jul. 28, 2005, now Pat. No. 7,389,737, which is a continuation of application No. 11/148,073, filed on Jun. 8, 2005, now abandoned.

(51) Int. Cl.
*B63B 17/00* (2006.01)

(52) U.S. Cl. ..... 114/361

(58) Field of Classification Search ..... 114/361; 135/88.01; 296/107.01, 107.08, 108, 116, 296/117

See application file for complete search history.

(56) References Cited

U.S. PATENT DOCUMENTS

| | | | | |
|---|---|---|---|---|
| 3,195,549 A | | 7/1965 | Stevens | |
| 5,016,558 A | * | 5/1991 | Oehler | 114/361 |
| 5,044,298 A | * | 9/1991 | Pepper et al. | 114/361 |
| 6,209,477 B1 | | 4/2001 | Biedenweg | |
| 6,349,666 B1 | * | 2/2002 | Hastings | 114/361 |
| 6,666,163 B2 | * | 12/2003 | Pastor et al. | 114/361 |
| 6,983,716 B1 | | 1/2006 | Ankney et al. | |
| 7,051,669 B2 | | 5/2006 | Warfel et al. | |
| 7,100,964 B2 | | 9/2006 | Macnee, III | |
| 2006/0162640 A1 | * | 7/2006 | Tufte | 114/361 |

FOREIGN PATENT DOCUMENTS

JP 362031515 A 2/1987

* cited by examiner

*Primary Examiner*—Ed Swinehart
(74) *Attorney, Agent, or Firm*—Botkin & Hall, LLP

(57) ABSTRACT

A powered bimini top is raised and lowered via a remote control. A power actuator operating the top includes a bi-directional reversible pump turned in one direction to lower the top to a fully retracted position and turned in the other direction to raise the top via hydraulic actuators. The top may alternatively be raised and lowered by a spring or a screw actuator. A rigid link is provided on either the watercraft or one of the main struts of the top. The pump, spring or screw actuator causes the main strut to be held against the rigid link (or the rigid link against the watercraft) with sufficient force to prevent substantial relative movement during transport. Secondary struts are biased toward corresponding main struts by elongated elastic cords. A pressure-responsive switch is provided on one of the struts to reverse direction of the top if the strut encounters an obstruction.

12 Claims, 9 Drawing Sheets

FOLDING TOP ASSEMBLY WITH SAFETY AND CONVENIENCE FEATURES

CROSS REFERENCE TO RELATED APPLICATIONS

This application is a continuation-in-part of U.S. patent application Ser. No. 11/192,383, filed Jul. 28, 2005 now U.S. Pat. No. 7,389,737, which is a continuation of U.S. patent application Ser. No. 11/148,073, filed Jun. 8, 2005, and now abandoned, the disclosures of which are hereby incorporated by reference.

BACKGROUND OF THE INVENTION

1. Field of the Invention

This invention relates to a folding top assembly for watercraft.

2. Description of the Background of the Invention

Deck, pontoon, and similar type watercraft are often equipped with a folding top, commonly referred to as a bimini top. The top includes struts that support a covering, typically of canvas, over some or all of the occupants when the top is deployed in the fully opened position to shade the occupants from the sun and to provide limited protection of the occupants during inclement weather. The top may be folded and fully retracted against the front or rear of the watercraft on cool days when direct sun is desirable, but many users also deploy the top in a so-called 'radar' position in which the top is folded, but the struts are deployed in an intermediate, angled position, thus providing for direct sun but also permitting easy access to all of the seats of the watercraft. As disclosed in the above-identified U.S. patent application Ser. Nos. 11/148,073 and 11/192,383, the folding top may be power operated. For convenience, it is desirable to be able to operate the top from a position away from the watercraft. This is particularly convenient in rear entry watercraft, the rear entry of which is blocked when the top is in the fully retracted position.

Watercraft having bimini tops are commonly transported on roads (for example, on trailers), and the bimini top must be restrained in the down position during road transport. Commonly, the prior art (such as U.S. Pat. No. 7,051,669) includes manually placed and removed devices to restrain the bimini top, which are obviously inconvenient and take time to place and remove. Also, for safety reasons, it is desirable, with powered bimini tops, to immediately reverse the top as it is traveling toward the fully retracted position, if the struts encounter an obstruction, so that the struts will not be damaged. Finally, bimini tops commonly have secondary struts which are pivotally connected to the main struts and provide additional support for the canvas top, and which must be folded against their corresponding main struts when the top is moved toward the folded or down position. A prior art design disclosed in U.S. Pat. No. 6,983,716 provides a torsion spring to retract the secondary struts, but this device concentrates the retracting force at the end of the strut attached to the main strut and is relatively ineffective.

SUMMARY OF THE INVENTION

The present invention relates to a powered bimini top assembly that is raised and lowered via a wireless remote control operable from on a watercraft or from off a watercraft. The power actuator operating the top includes a bi-directional reversible pump and hydraulic actuators. The pump is turned in one direction to lower the bimini top to the folded position and in the other direction to raise the top. Alternatively, a screw actuator may be used, which is turned in opposite directions to raise or lower the top. The wireless remote control is used to control the pump or the screw actuator to raise or lower the top. A rigid link is provided on either the watercraft or one of the struts and provides a rigid (but unlatched) connection between the strut and the watercraft when the top is in the folded or fully retracted position. The screw actuator or the pump causes the actuator to hold the strut against the rigid link (or the rigid link against the watercraft) with sufficient force to prevent substantial relative movement between the strut and the watercraft during transport. The secondary struts are biased toward their corresponding main struts by an elongated elastic cord which is connected between the secondary struts and corresponding main struts and extends along the secondary struts so that the biasing forces urging the secondary struts toward the main struts are distributed along the length of the secondary struts. A pressure-responsive switch is provided on one of the struts to reverse direction of the bimini top if the struts encounter an obstruction.

DETAILED DESCRIPTION OF INVENTION

Figure 1:
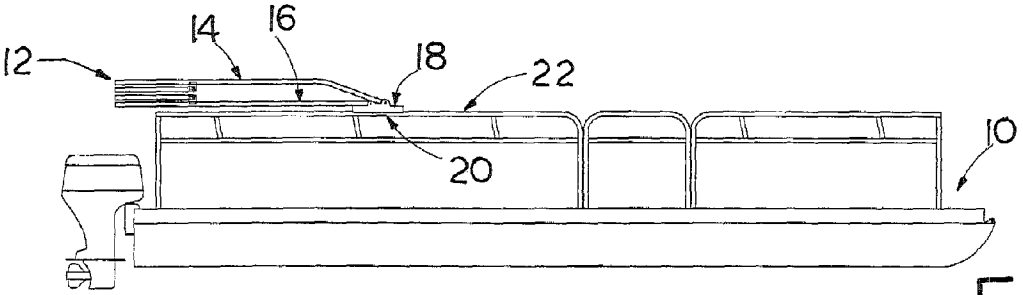
FIG. 1, FIG. 2 and FIG. 3 are each side elevation views of a typical watercraft having a folding top employing the present invention, the top being illustrated in the fully retracted, radar and fully open positions respectively, the canvas cover having been omitted for clarity in FIGS. 1 and 2.
Figure 2:
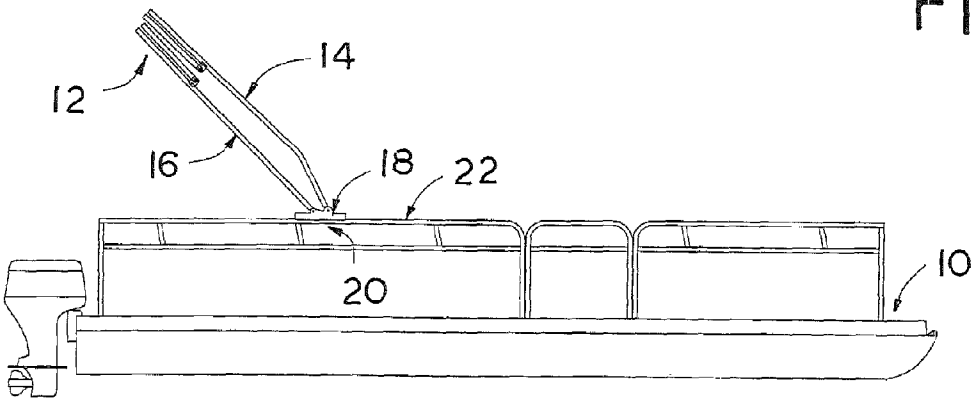
Figure 3:
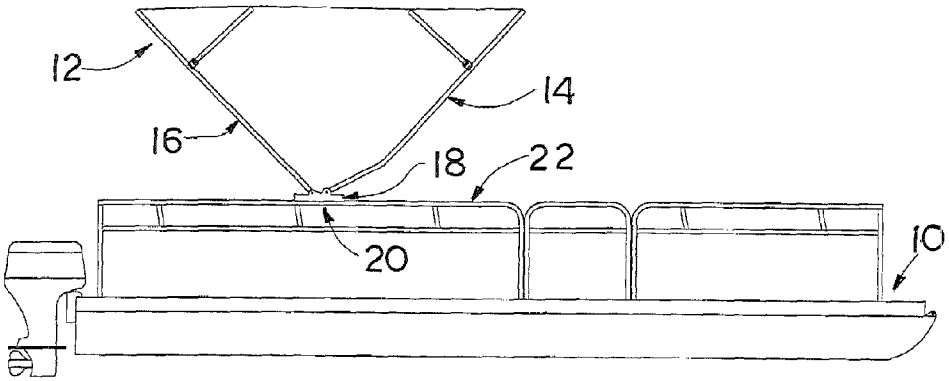

Referring now to FIGS. 1-3, a typical watercraft employing the present invention is illustrated at 10, including a folding or bimini top generally indicated by the numeral 12. As is most clearly seen in FIG. 10A, the top 12 includes a canvas cover 13, which is supported by a pair of primary front and rear struts 14, 16, each of which are generally 'U' shaped and include a pair of generally parallel legs 116, 118, which are connected by transverse legs 120, which bridge across the open deck of the watercraft 10. Leg 118 of strut 14 is pivotally connected to a housing 18 of an actuator 20 at pivot 122, and leg 116 of strut 14 is pivotally connected to housing 18 of an actuator 21 opposite actuator 20 at pivot 128. Similarly, leg 118 of strut 16 is pivotally mounted on the housing 18 of actuator 20 at pivot 126, and leg 116 of strut 16 is pivotally mounted on housing 18 of actuator 21 at pivot 124. A pair of generally 'U' shaped secondary struts 15, 17 each includes a pair of parallel legs 130, 132 connected by transverse legs 134, which bridge across the open deck of the watercraft 10. The ends of the legs 130, 132 of secondary strut 15 are pivotally connected to corresponding legs 116, 118 of primary strut 14 by pivots 84, 85 and the ends of legs 130, 132 of secondary strut 17 are pivotally connected to corresponding legs 116, 118 of primary strut 16 by pivots 86, 87. The front and rear edges of the top 13 are folded over and closed by either sewing or zippers (not shown) to define sleeves 136 receiving transverse legs 120, thereby securing the top 13 to the struts 14, 16. Similarly, pockets 138 are formed intermediate the front and rear by attaching fabric patches by sewing or zippers to the top 13, thereby defining sleeves receiving the transverse legs 134 of the secondary struts 15, 17, thus securing the top 13 to the secondary struts 15, 17. If zippers are used to close the pockets to form the sleeves, installation and removal of the top 13 on the struts 14, 16, 15, 17 is facilitated.

Figure 10:
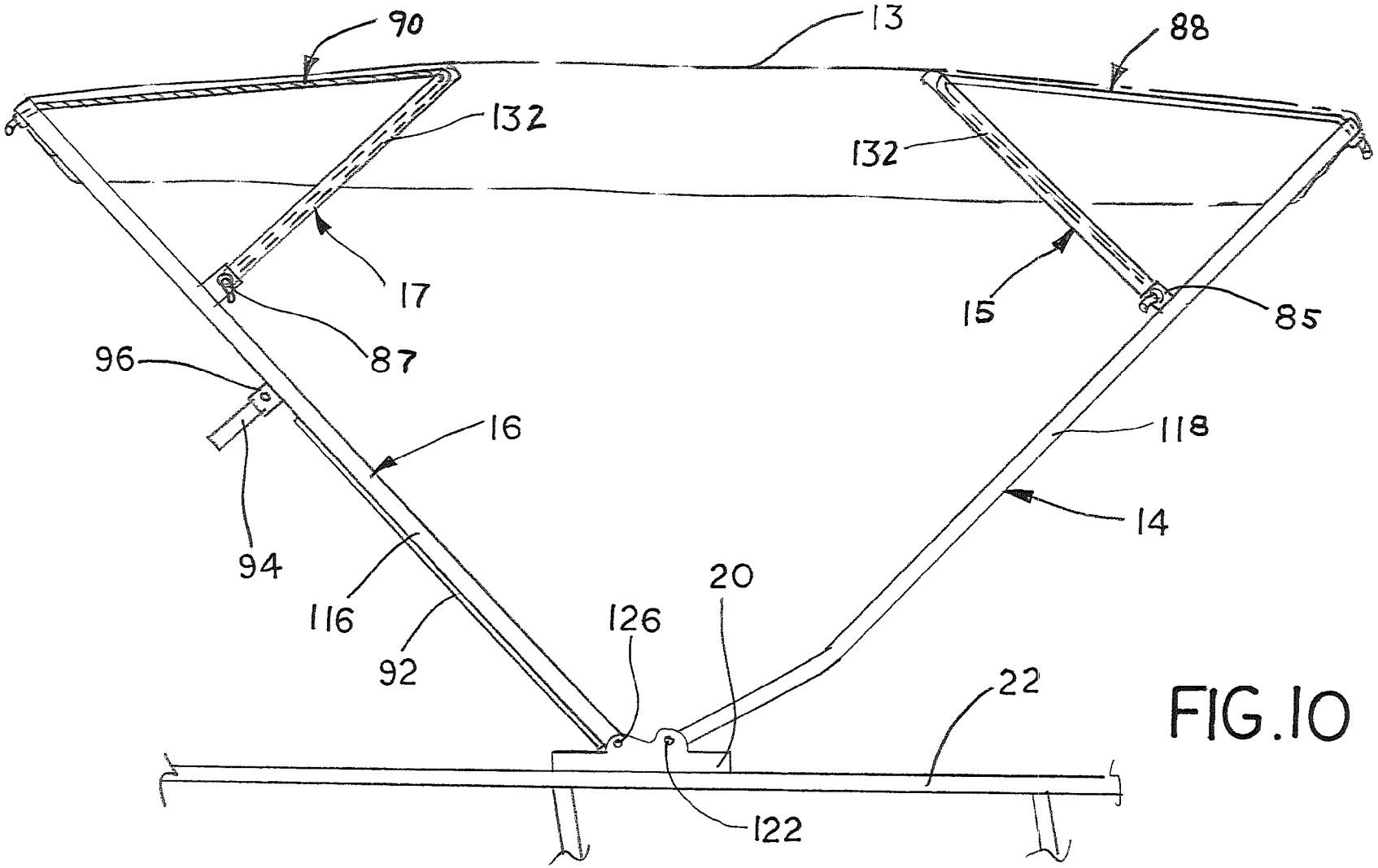
FIG. 10 is an enlarged, fragmentary side elevational view of a folding top made pursuant to the present invention installed on a watercraft and illustrating the elastic cord, the strut pressure safety switch, and the fixed travel strut; the folding top being in the fully open position.
Figure 10A:
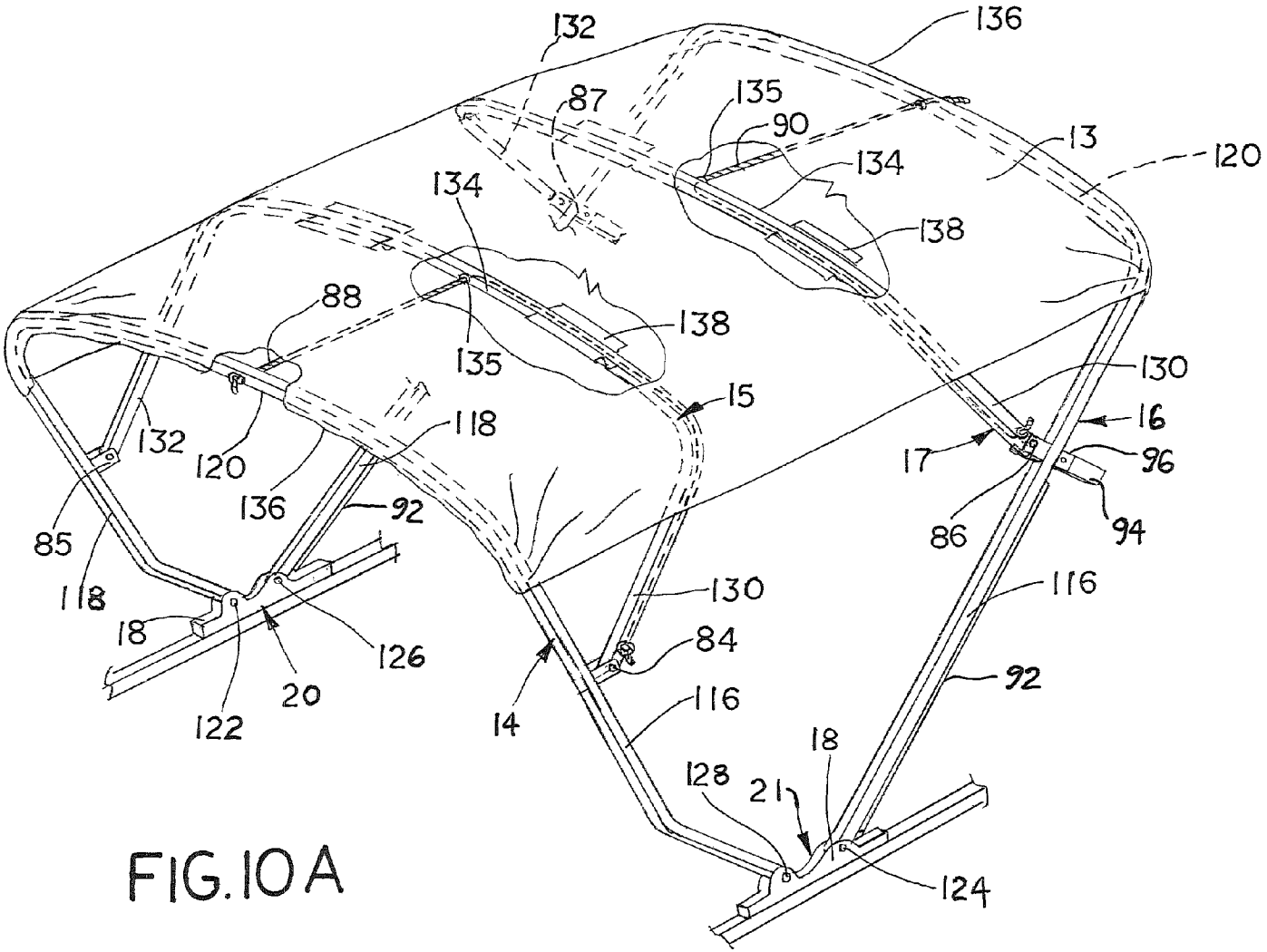
FIG. 10A is a view in perspective of the folding top and struts in the fully open position.

To assist in retracting the secondary struts 15, 17 toward their corresponding main struts 14 and 16 when the top 12 is folded into the fully folded or radar positions illustrated in FIGS. 1 and 2, one end of elongated elastic cords 88, 90 is connected to legs 130 of each of the secondary struts 15, 17 adjacent their pivot connections 84, 86 with their corresponding main strut 14 or 16. The elastic cords 88, 90 extend along the leg 130 of their corresponding secondary strut and then extend along the adjoining transverse leg 130 to substantially the midpoint thereof, as shown in FIG. 10A. The elastic cords 88, 90 then extend through openings 135 in their corresponding transverse leg 134 and extend from there to the transverse leg 120 of the adjacent main strut 14 or 16, where the end of the cord is fastened. The elastic cords 88, 90 are slidable relative to the legs 130 and 134, and are stretched when the folding top 12 is in the fully open position. Accordingly, the elasticity of the cords biases the secondary struts 15, 17 toward the main struts as the bimini top is folded. Since force is applied to the secondary struts at a point adjacent to where they engage the bimini top, the elastic force of the cords is applied at the end of the lever arm defined by the legs 130, thus assuring smooth retraction. Alternatively, the elastic cords 88, 90 may extend along and be connected to the legs 132 as shown in FIG. 10, performing a substantially similar function, yet on the opposite side of the bimini top 12.

Figure 4:
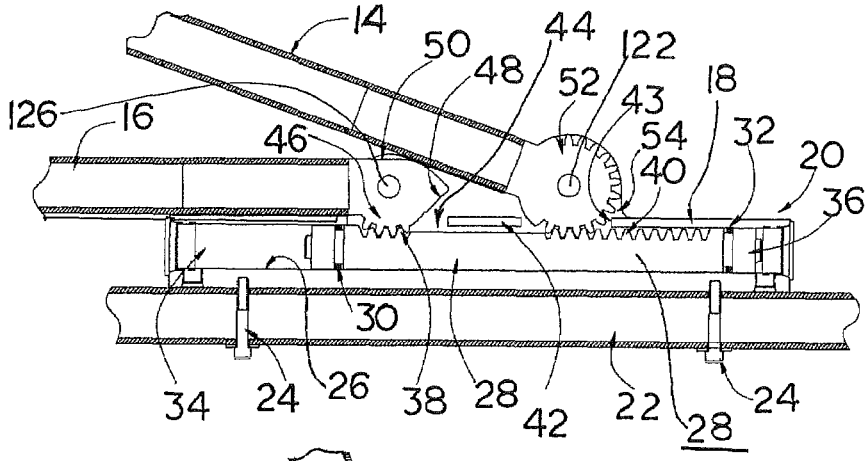
FIG. 4, FIG. 5 and FIG. 6 are enlarged, fragmentary cross sectional views of the lower portion of the struts illustrated in FIGS. 1-3 and a corresponding one of the actuators made pursuant to the present invention, illustrating the components in the fully retracted, radar and fully open positions respectively.
Figure 11:
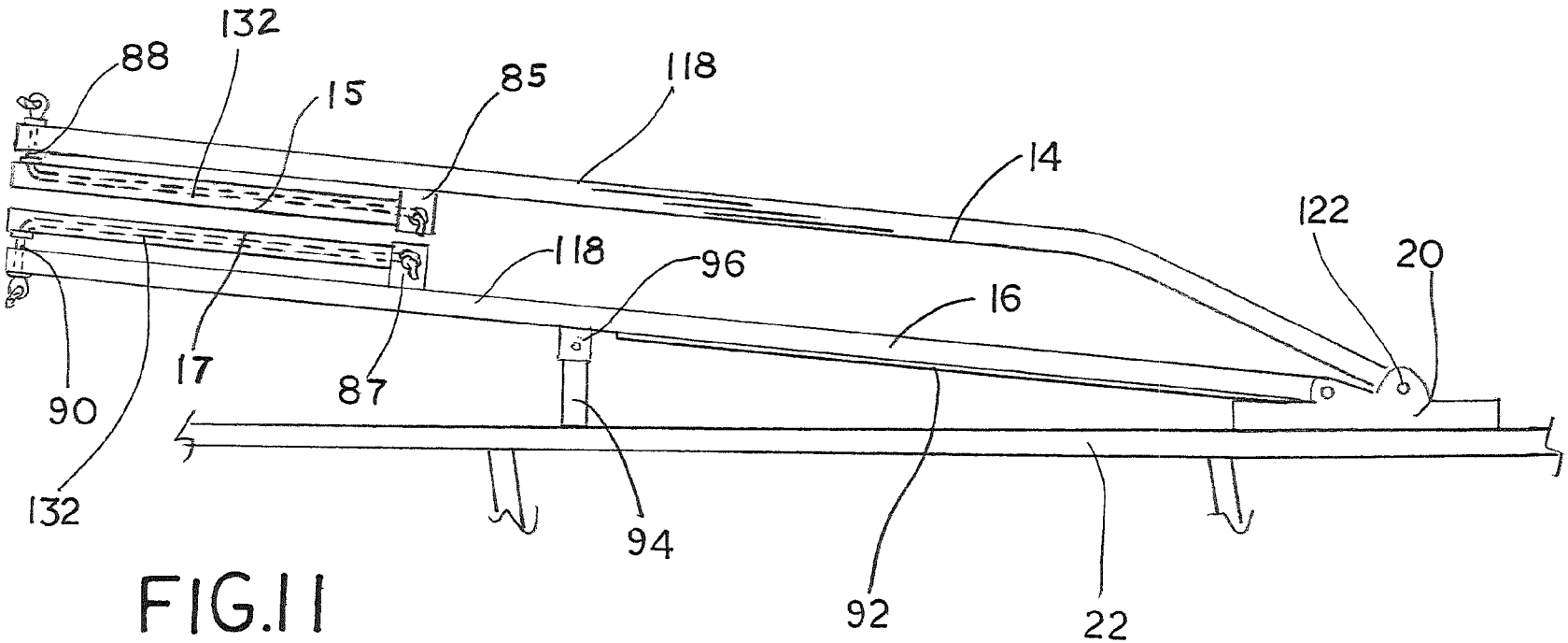
FIG. 11 is a view similar to FIG. 10, but illustrating the folding top in the fully retracted position, the canvas top having been omitted for clarity.
Figure 12:
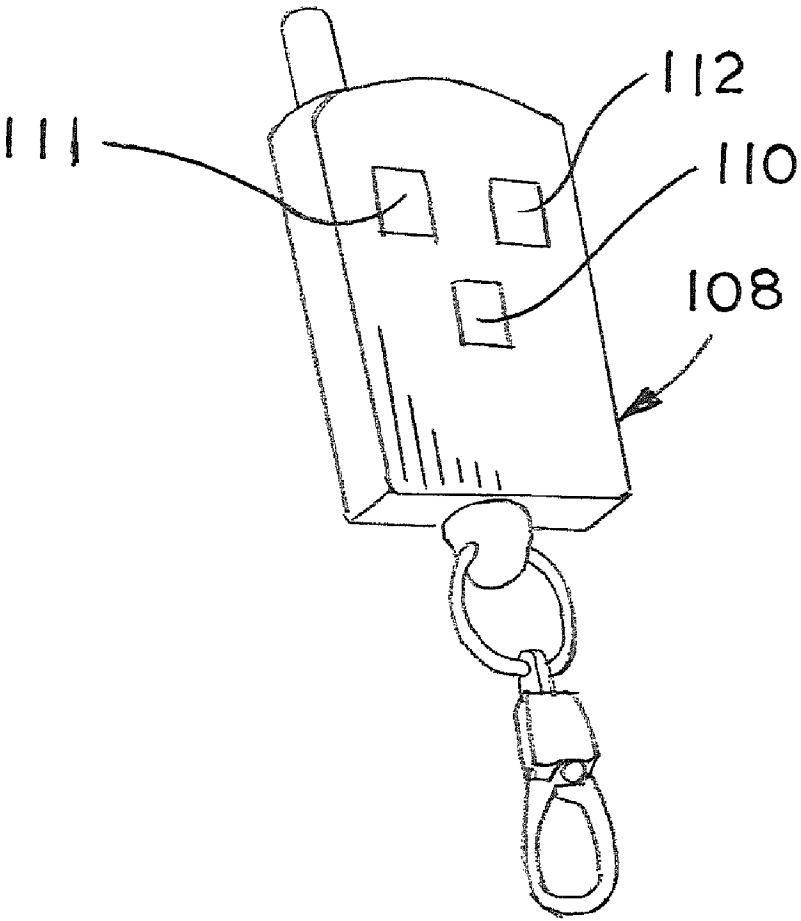
FIG. 12 is a view in perspective of a user-operated remote control signal generator used in the present invention.

It is desirable that the bimini top 12 not be moved into the fully retracted position if an obstruction prevents movement of the struts 14, 15, 16 and 17 into their fully retracted positions as illustrated in FIGS. 1, 4 and 11. Accordingly, pressure responsive strips 92 are mounted along the strut 16 extending from the actuators 20 and 21, which act as a safety switch. The strips 92 respond to pressure generated by engagement with an obstruction to cause reversal of the struts 14, 15, 16 and 17 back toward the fully open position, as will be hereinafter explained.

Watercraft 10 is commonly transported on highways (for example, on a trailer pulled by a towing vehicle). When the watercraft 10 is being transported in this manner, it is desirable that vibrations and relative movement between the struts 14, 15, 16 and 17 and top rail 22 of the watercraft 10 be minimized. Accordingly, relatively short rigid links 94 may be mounted on brackets 96 via a connection that allows limited pivoting of the links 94 with respect to the strut 16 such that the links 94 engage the rail 22 when the bimini top 12 is in the fully retracted position (FIG. 11) so that a rigid connection between the links 94 and the watercraft 10 is provided. The links 94 and the strut 16 merely engage the rail 22 and are not latched or otherwise connected thereto, so that the bimini top 12 is readily deployed from the fully retracted position. Alternatively, the links 94 may be mounted on the rail 22 and the strut 16 brought into engagement with the links 94 when the bimini top 12 is in the fully retracted position.

The actuators 20, 21 are each mounted on top rail 22 on opposite sides of the watercraft 10 and are operated simultaneously to fold and deploy the top 12. However, since the actuators are identical, only one will be described in detail. In the fully retracted position of the top 12 as illustrated in FIG. 1, the folded top 12 obstructs some of the seats at the rear of the watercraft 10. However, the top 12 can be moved from the folded position of FIG. 1 into an intermediate or radar position illustrated in FIG. 2. In this position, the top 12 remains folded so that almost the entire deck is exposed, but the rear of the watercraft 10 is not obstructed. The strut 16 remains locked in the position illustrated in FIG. 2 as the strut 14 is pivoted away from strut 16 into the position illustrated in FIG. 3, in which the top 12 is in the fully open position.

Figure 5:
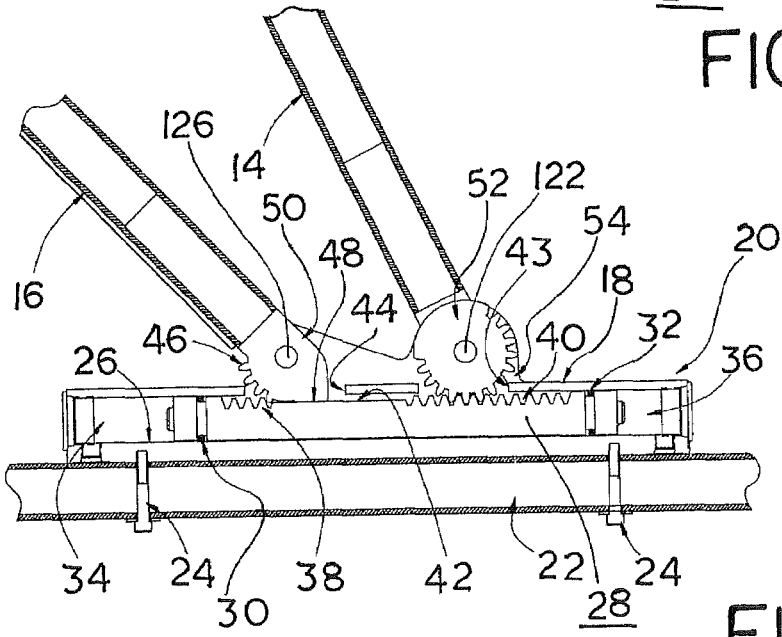
Figure 6:
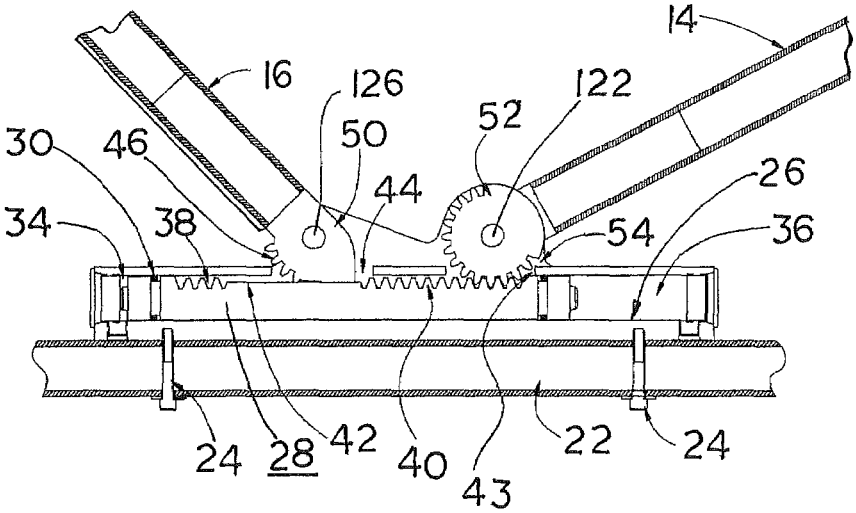

Referring now to FIGS. 4-6, the housing 18 is mounted on the top rail 22 by fasteners 24 and defines a bore 26 therewithin, which slidably receives a piston or shuttle 28. Circumferentially extending seals 30, 32 circumscribe circumferential end portions of the piston 28 so that opposite ends of the piston 28 cooperate with corresponding ends of the bore 26 to define pressure chambers 34, 36 therebetween. A pair of substantially flat, toothed racks 38, 40 is defined on the piston or shuttle 28 and is separated by a substantially flat sliding surface 42. It will be noted that the rack 40 is substantially longer than the rack 38, and that the stroke of the shuttle 28 is sufficient that the strut 16 is urged against the link 94 when the top 12 is in the folded position.

Slots 43, 44 are defined in the housing 18 to receive a corresponding one of the struts 14, 16. Strut 16 terminates in a driving mechanism including a gear sector 46 extending over a relatively small arc which engages the rack 38 when the strut 16 is being moved between the fully retracted and the radar positions. A substantially flat sliding surface 48 extends from the gear sector 46 and is shaped to slidably engage the sliding surface 42 on the piston 28 after the strut 16 has been rotated into a predetermined angular orientation. Strut 16 is pivotally connected to a projecting ear 50 on housing 18 adjacent the slot 44. Strut 14 terminates in a driving mechanism including a gear sector 52 that extends over an arc substantially greater than the arc defined by gear sector 46 on the strut 16. Gear sector 52 engages the rack 40, and both the rack 40 and gear sector 52 are of sufficient length that the strut 14 can be rotated from the fully retracted to the fully open positions. Strut 14 is pivotally connected to a projecting ear 54 on housing 18 adjacent the slot 43.

As discussed above, the struts 14, 16 are illustrated in FIG. 4 in the positions they assume when the top 12 is in the fully retracted position illustrated in FIG. 1. When it is desired to raise the top 12, the shuttle or piston 28 is moved to the left, thereby rotating the struts 14, 16 clockwise through substantially the same arc until the struts 14, 16 are rotated into a predetermined angular position illustrated in FIG. 5 which represents the radar position of the top 12 illustrated in FIG. 2. Since both struts are rotated through substantially the same arc, the top 12 remains folded. As the piston 28 is moved past the FIG. 5 position, the sliding surface 48 engages the sliding surface 42 on the piston 28, to thereby lock the strut 16 in the predetermined angular position, while permitting the strut 14 to continue to rotate due to it remaining in driving engagement with the rack 40. Accordingly, the strut 14 is rotated into the fully open position illustrated in FIG. 6, which represents the position of the top 12 illustrated in FIG. 3, while the strut 16 remains locked in the predetermined angular position. When an operator desires to fold the top 12, the piston 28 is moved to the right, thereby folding the strut 14 back into the FIG. 5 position before both struts 14, 16 are rotated together back to the fully retracted position of FIG. 4.

Figure 7:
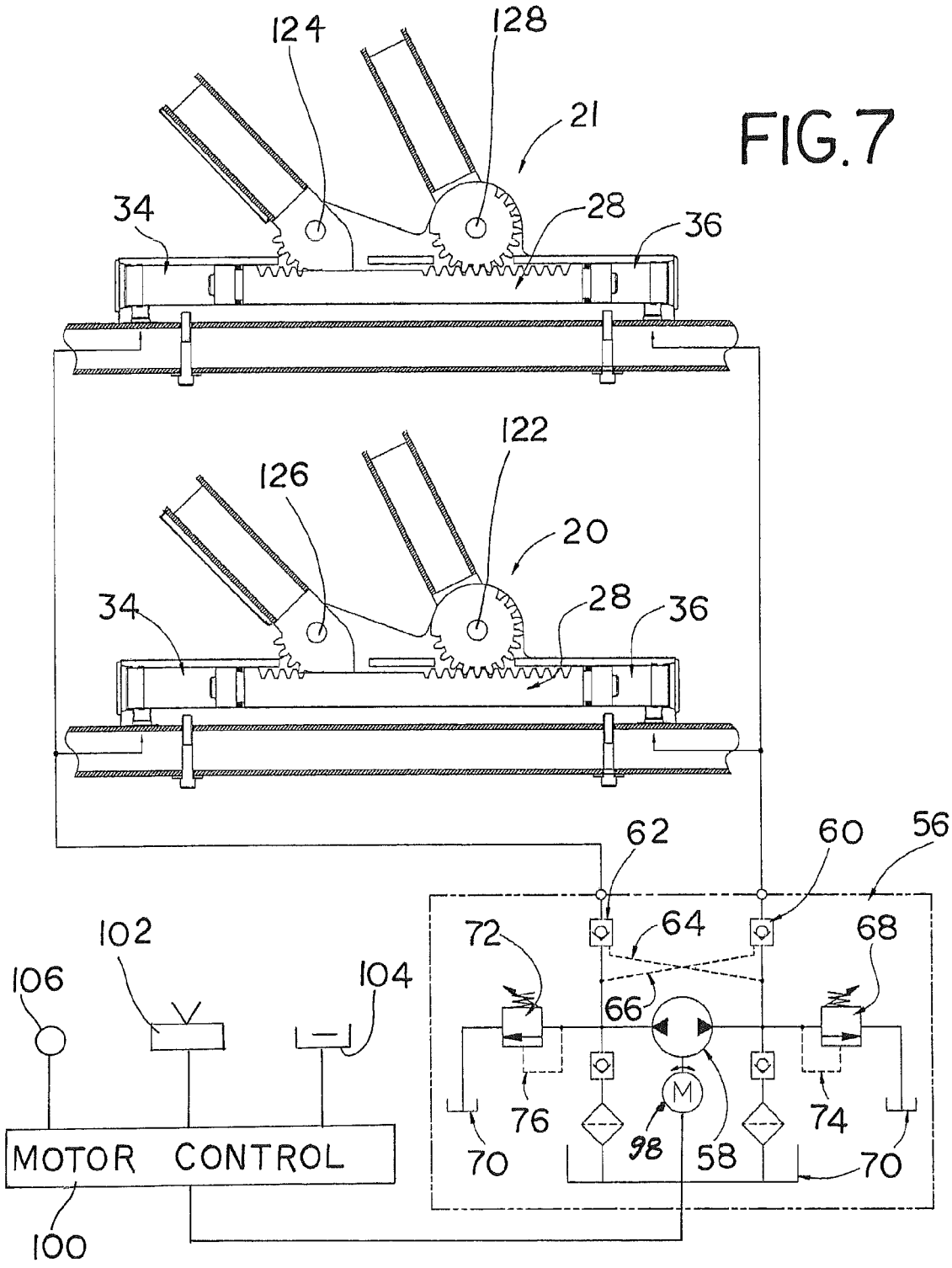
FIG. 7 is a cross-sectional view of both actuators illustrated in a hydraulic schematic diagram illustrating the manner in which the actuators of the present invention are powered.

The pistons 28 may be moved hydraulically or mechanically. The hydraulic system illustrated in FIG. 7 may be used to pressurize one of the chambers 36 or 34 and vent the other chamber to a reservoir 70 to drive the pistons 28 in the desired direction. In FIG. 7, the actuators 20, 21 on opposite sides of the watercraft 10 are both illustrated. A hydraulic system generally indicated by the numeral 56 includes a reversible hydraulic pump 58, one side of which is connected to chambers 36 of the actuators 20, 21 through pilot-operated check valve 60 and to the chambers 34 through pilot-operated check valve 62. Check valves 60, 62 normally check flow in the direction indicated in the absence of a pressure signal in the corresponding pilot pressure lines 64, 66. Check valve 62 is set to maintain a predetermined pressure level in the chambers 34 when the pump 58 is turned off with the top in the fully retracted position that is sufficient to maintain the strut 16 in engagement with the links 94 to resist relative movement and/or vibrations between the struts 14, 15, 16 and 17 and the top rail 22 when the watercraft 10 is transported. Valve 68 controls communication and maximum hydraulic pressure between chambers 36 and the reservoir 70, and valve 72 controls communication and maximum hydraulic pressure between the chambers 34 and the reservoir 70. The pump 58 draws fluid from the reservoir 70 and communicates pressure either through check valve 60 or check valve 62, depending upon the direction the pump 58 is driven. When the pump 58 is driven in the direction pressurizing chamber 36, the check valve 62 is held open by pilot pressure in the line 64. Accordingly, the piston 28 is driven to the left as shown in FIGS. 4-6, deploying the top 12. When it is desired to retract the top 12, the pump 58 is driven in the direction pressurizing chambers 34 through check valve 62, check valve 60 being held open by pressure in pilot line 66, to permit pressure to vent from the chambers 36. When it is desired to hold the top 12 in one of the fully retracted, radar, or fully open position (or any position in between), the pump 58 is turned off and both valves 60 and 62 are closed, thereby holding pressure in both chambers 34 and 36. The valves 68 and 72 are provided with pilot signals through lines 74 and 76, to limit the pressures in the chambers 34 and 36. The valves 68 and 72 may be set differently, so that a lower pressure is used to move the top 12 from the fully open to the fully retracted position than is used to move the top 12 from the fully retracted to the fully open position, since the weight of the top 12 assists in moving the top 12 to the fully retracted position.

The reversible pump 58 is driven by a bi-directional electric motor 98. The motor 98 is controlled by a controller 100, which receives inputs from a three-position switch 102, which is preferably mounted adjacent the watercraft 10 controls. The three-position switch 102 has neutral, up and down positions to raise and lower the top 12 in a conventional manner. Motor control 100 also has a safety switch input 104, which is connected to the pressure strips 92. The switch 104 causes the controller 100 to reverse direction of the top 12 (to return the top 12 toward the fully open position) when the top 12 is moving to the fully retracted position and the pressure responsive strips 92 sense an obstruction. The controller 100 further includes a sensor 106, which is responsive to radio frequency (RF) signals from a user-operated wireless remote control generally indicated by the numeral 108. The sensor 106 responds to the signal generated by a button 110 on wireless remote control 108 to "power up" the controller 100, and to the buttons 111 and 112 to raise and lower the top 12, respectively. The wireless remote control 108 has a range sufficient so that it may be used either on the watercraft 10, or on a dock immediately adjacent the watercraft 10. Accordingly, the top 12 may be raised or lowered when all passengers have left the watercraft 10. Many watercraft using the bimini top 12 of the present invention may be entered and exited through the rear, which is not possible with the top 12 in the fully retracted position. Accordingly, the top 12 may be positioned in the fully open position while the passengers disembark and then lowered to the fully retracted position from a location on the dock immediately adjacent the watercraft 10 after all passengers have exited the watercraft 10. Conversely, the top 12 may be stored in the fully retracted position when the watercraft 10 is not being used and then raised to the fully open position before embarkation of passengers.

Figure 8:
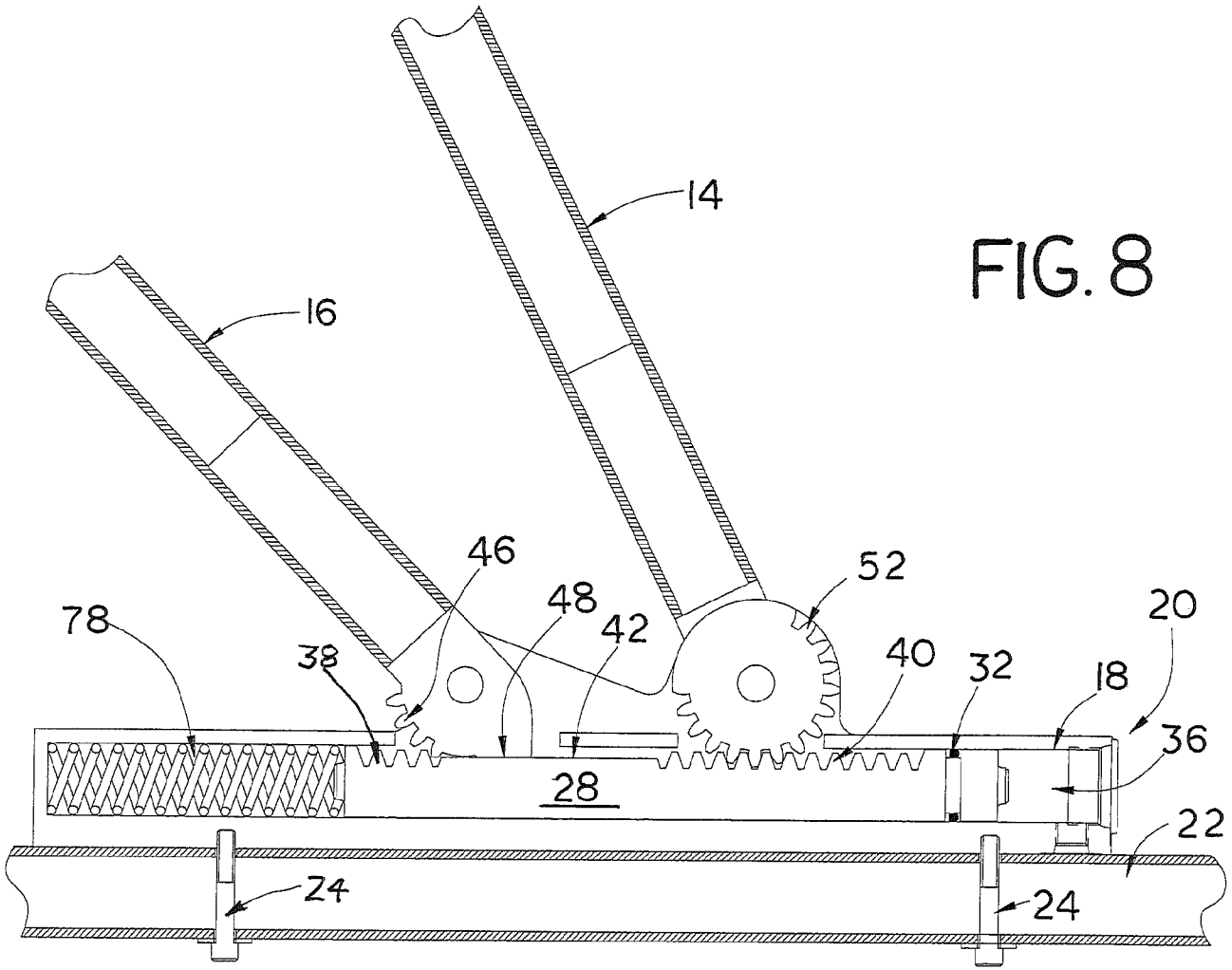
FIG. 8 and FIG. 9 are views similar to FIG. 5 but illustrating alternate embodiments of the invention.
Figure 9:
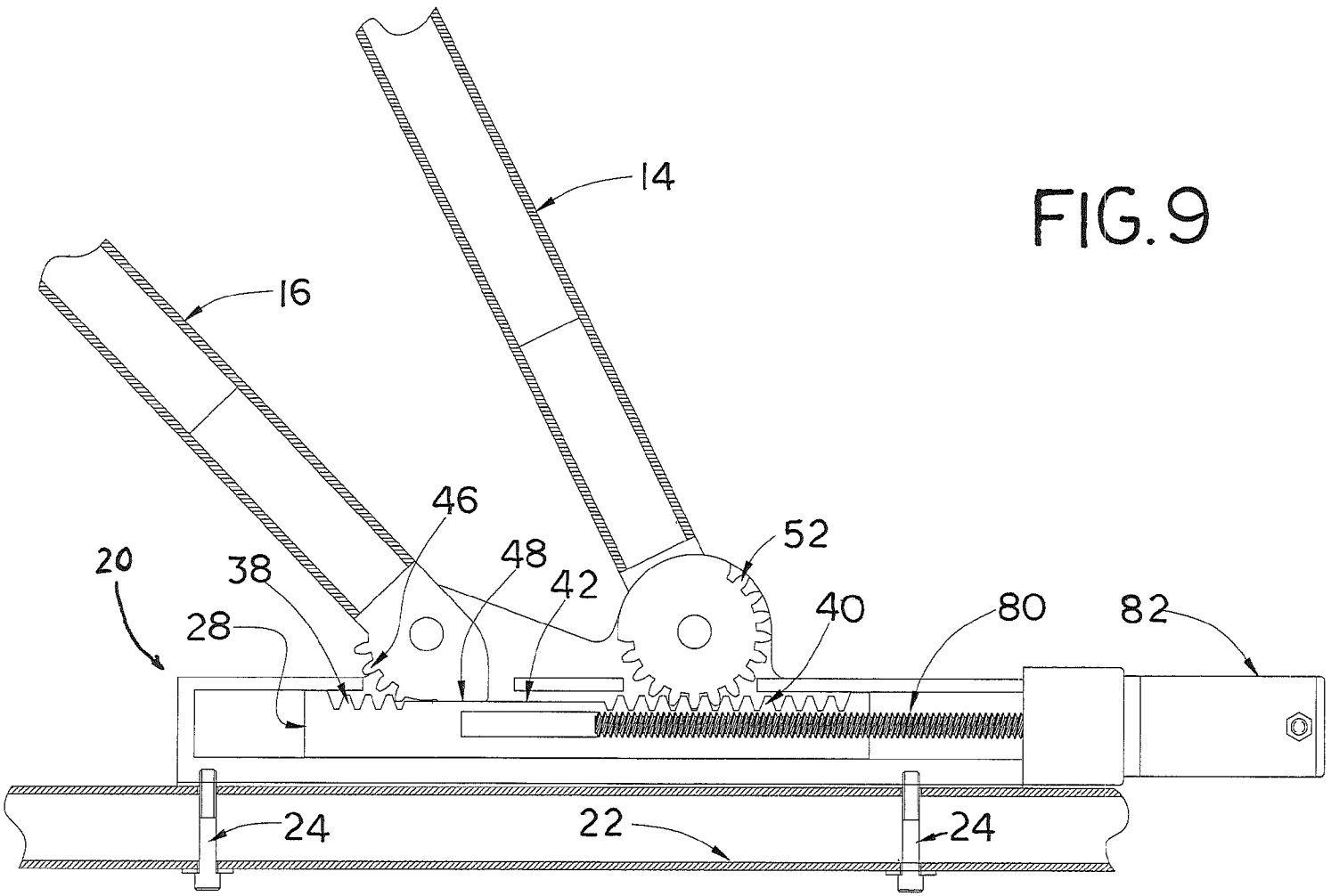

Referring to the alternate embodiment of the actuator 20 (which is identical to the actuator 21) of FIG. 8, a spring 78 may be used in the chamber 34 to bias the piston 28 of the actuator 20 to the closed position, fluid pressure only being used to move the top 12 to the fully open position. The top 12 may be biased toward the fully open position by placing the spring 78 in the chamber 36 and using fluid pressure in the chamber 34 to move the top 12 to the fully retracted position. Referring to the alternate embodiment of the actuator 20 of FIG. 9, the piston 28 includes a threaded portion that is threadedly engaged with a jackscrew 80 which is turned by a bi-directional electric gearmotor 82 to move the piston 28, to thereby move the top 12 between the fully retracted and fully open positions.

What is claimed is:

1. Folding top assembly for a vehicle, comprising a pair of main struts pivotally mounted for pivotal movement relative to one another and relative to the vehicle, a covering supported by said struts, an actuator for moving said struts from a retracted position to an open position in which the covering is deployed to cover at least a portion of the vehicle, a double acting shuttle, said shuttle being connected to each of said struts and movable in one direction to move the folding top assembly into the open position, said shuttle being movable in the other direction to move the folding top assembly into the retracted position, a control means switchable from a first condition causing said shuttle to be moved in said one direction to a second condition moving said shuttle in said other direction, said control means including signal receiving means for receiving a control signal switching said control means between said first and second conditions, and a control signal generating means operable distanced from said vehicle for generating said control signal, and an obstruction-responsive switch mounted on one of said struts, said obstruction-responsive switch being responsive to engagement of said one strut with an obstruction as said one strut moves toward said retracted position, said control means being responsive to said obstruction-responsive switch to reverse movement of said one strut from movement toward the retracted position to movement toward the open position.

2. Folding top assembly as claimed in claim 1, wherein said obstruction-responsive switch is an elongated strip mounted on said one strut, extending along the length of said one strut, and being responsive to pressure generated by engagement with an obstruction anywhere along the length of the obstruction-responsive switch to reverse movement of said strut.

3. Folding top assembly as claimed in claim 1, wherein said obstruction-responsive switch is an elongated strip mounted on said one strut, extending along the length of said one strut, and being responsive to pressure generated by engagement with an obstruction anywhere along the length of the obstruction-responsive switch to reverse movement of said strut.

4. Folding top assembly for a vehicle, comprising a pair of main struts pivotally mounted for pivotal movement relative to one another and relative to the vehicle, a covering supported by said struts, an actuator for moving said struts from a retracted position to an open position in which the covering is deployed to cover at least a portion of the vehicle, a double acting shuttle, said shuttle being connected to each of said struts and movable in one direction to move the folding top assembly into the open position, said shuttle being movable in the other direction to move the folding top assembly into the retracted position, a control means switchable from a first condition causing said shuttle to be moved in said one direction to a second condition moving said shuttle in said other direction, said control means including signal receiving means for receiving a control signal switching said control means between said first and second conditions, and a control signal generating means operable distanced from said vehicle for generating said control signal, a pair of secondary struts pivotally mounted to a corresponding main strut and engaging and supporting said folding top assembly, and an elongated, elastic cord extending between each of the secondary struts and its corresponding main strut to assist in retracting the secondary struts toward their corresponding main strut as the main struts are moved toward the retracted position.

5. Folding top assembly as claimed in claim 4, wherein each of said elastic cords has one end attached to a secondary strut and extends along said secondary strut to a point adjacent said corresponding main strut, each of said cords having an opposite end secured to the corresponding main strut.

6. Folding top assembly for a vehicle, comprising:

a pair of main struts pivotally mounted on the vehicle and pivotal relative to one another and relative to the vehicle;

a covering supported by said struts;

an actuator for moving said struts from a retracted position to an open position in which the covering is deployed to cover at least a portion of the vehicle;

a pair of secondary struts, each of which is pivotally connected to a corresponding main strut, each of said secondary struts engaging and supporting said folding top assembly;

an elongated, elastic cord extending between each of the secondary struts and their corresponding main strut to assist in retracting the secondary struts toward their corresponding main strut as the main struts are moved toward the retracted position.

7. Folding top assembly as claimed in claim 6, wherein each of said main and secondary struts includes a pair of side legs and a transverse leg connecting said side legs and bridging across said vehicle, the side legs of said secondary struts being connected to the side legs of a corresponding main strut via a pivot connection, each of said elastic cords having one end attached to one of said secondary strut legs and the other end to a leg of the corresponding main strut.

8. Folding top assembly as claimed in claim 7, wherein each of said elastic cords has an end attached to one of said secondary strut side legs adjacent one of the pivot connections and another end connected to one of said transverse legs of the corresponding main strut.

9. Folding top assembly as claimed in claim 8, wherein each of said elastic cords extends along one of said secondary strut side legs and along said secondary strut transverse leg to a point intermediate the ends thereof, and from said point to the transverse leg of the corresponding main strut.

10. Folding top assembly as claimed in claim 9, wherein each of said elastic cords slides relative to each of said secondary struts as the elastic cords elongate and retracts as the folding top assembly is moved to the retracted position.

11. Folding top assembly as claimed in claim 6, wherein each of said elastic cords has one end attached to a secondary strut adjacent a pivot connection with its corresponding main strut and extends along said secondary strut, each of said elastic cords having an opposite end secured to the corresponding main strut adjacent said other end of the corresponding main strut.

12. Folding top assembly for a vehicle, comprising a pair of main struts pivotally mounted for pivotal movement relative to one another and relative to the vehicle, a covering supported by said struts, an actuator for moving said struts from a retracted position to an open position in which the covering is deployed to cover at least a portion of the vehicle, a double acting shuttle, said shuttle being connected to each of said struts and movable in one direction to move the folding top assembly into the open position, said shuttle being movable in the other direction to move the folding top assembly into the retracted position, a control means switchable from a first condition causing said shuttle to be moved in said one direction to a second condition moving said shuttle in said other direction, and an obstruction-responsive switch mounted on one of said struts, said obstruction-responsive switch being responsive to engagement of said one strut with an obstruction as said one strut moves toward said retracted position, said control means being responsive to said obstruction-responsive switch to reverse movement of said one strut from movement toward the retracted position to movement toward the open position.

* * * * *